US007275621B1

(12) United States Patent
Delgado, Jr.

(10) Patent No.: US 7,275,621 B1
(45) Date of Patent: Oct. 2, 2007

(54) SKEW HORN FOR A LOUDSPEAKER

(75) Inventor: Rogelio Delgado, Jr., Rosston, AZ (US)

(73) Assignee: Klipsch, LLC, Indianapolis, IN (US)

( * ) Notice: Subject to any disclaimer, the term of this patent is extended or adjusted under 35 U.S.C. 154(b) by 216 days.

(21) Appl. No.: 11/037,320

(22) Filed: Jan. 18, 2005

(51) Int. Cl.

| | |
|---|---|
| ***G10K 11/02*** | (2006.01) |
| ***H04R 1/02*** | (2006.01) |
| ***H04R 1/08*** | (2006.01) |
| ***H04R 1/14*** | (2006.01) |
| ***H04R 1/30*** | (2006.01) |

(52) U.S. Cl. ..... 181/192; 181/150; 181/152; 181/159; 181/191; 181/195; 381/339; 381/340; 381/342

(58) Field of Classification Search ..... 181/192, 181/152, 159, 191, 195, 30, 150; 381/337, 381/339, 340, 342, 338
See application file for complete search history.

(56) References Cited

U.S. PATENT DOCUMENTS

| | | | | |
|---|---|---|---|---|
| 1,381,430 | A | 6/1921 | Phipps | |
| 1,874,733 | A | 8/1932 | Zwikker | |
| 2,135,610 | A | 11/1938 | Wente | |
| 2,440,078 | A * | 4/1948 | Devine | 181/154 |
| 2,642,948 | A * | 6/1953 | Olson et al. | 181/152 |
| 4,116,302 | A | 9/1978 | Seebinger | |
| 4,138,594 | A * | 2/1979 | Klipsch | 381/335 |
| 4,194,590 | A * | 3/1980 | Anderson et al. | 181/186 |
| 4,348,549 | A | 9/1982 | Berlant | |
| 4,369,857 | A | 1/1983 | Frazer et al. | |
| 4,580,655 | A * | 4/1986 | Keele, Jr. | 181/192 |
| 4,790,408 | A | 12/1988 | Adair | |
| 4,823,908 | A | 4/1989 | Tanaka et al. | |
| 4,923,032 | A * | 5/1990 | Nuernberger | 181/150 |
| 5,000,286 | A * | 3/1991 | Crawford et al. | 181/145 |
| 5,020,630 | A | 6/1991 | Gunness | |
| 5,103,482 | A * | 4/1992 | Fabri-Conti | 381/340 |
| 5,187,333 | A | 2/1993 | Adair | |
| 5,233,136 | A | 8/1993 | Hamada | |
| 5,526,456 | A | 6/1996 | Heinz | |
| 5,616,892 | A | 4/1997 | Ferralli | |
| 5,737,435 | A * | 4/1998 | De Poortere et al. | 381/340 |
| 6,009,182 | A * | 12/1999 | Gunness | 381/182 |
| 6,038,326 | A | 3/2000 | Czerwinski | |
| 6,095,279 | A | 8/2000 | Adamson | |

(Continued)

FOREIGN PATENT DOCUMENTS

| | | |
|---|---|---|
| JP | 0457487 | 11/1991 |

(Continued)

*Primary Examiner*—Lincoln Donovan
*Assistant Examiner*—Jeremy Luks
(74) *Attorney, Agent, or Firm*—Daniel L. Boots; David E. Novak; Bingham McHale LLP

(57) ABSTRACT

A horn including a substantially flat coupling flange defining a coupling flange plane, a substantially planar mouth defining a mouth plane, an elongated throat extending between the coupling flange and the mouth, a transducer for generating a sonic output operationally connected to the coupling flange, and a major axis extending through the elongated throat. The coupling flange plane and the mouth plane are nonparallel and define a horn angle. The major axis connects the coupling flange and the mouth and the elongated throat is characterized by a substantially steadily increasing sectional area along the major axis from the transducer-connecting end to the mouth connecting end.

20 Claims, 13 Drawing Sheets

U.S. PATENT DOCUMENTS

| | | | | |
|---|---|---|---|---|
| 6,112,847 | A | 9/2000 | Lehman | |
| 6,257,365 | B1 | 7/2001 | Hulsebus, II | |
| 6,343,134 | B1 | 1/2002 | Czerwinski | |
| 6,394,223 | B1 | 5/2002 | Lehman | |
| 6,574,344 | B1 | 6/2003 | Wiener et al. | |
| 6,585,077 | B2 | 7/2003 | Vincenot et al. | |
| 6,621,909 | B1 | 9/2003 | Webb et al. | |
| 6,658,128 | B1 | 12/2003 | Yoshioka et al. | |
| 6,668,969 | B2 | 12/2003 | Meyer et al. | |
| 6,712,177 | B2 | 3/2004 | Ureda | |
| 2002/0029926 | A1* | 3/2002 | Vincenot et al. | 181/192 |
| 2003/0069710 | A1 | 4/2003 | Geddes | |
| 2003/0161483 | A1 | 8/2003 | Byers | |
| 2003/0219139 | A1 | 11/2003 | Baird et al. | |
| 2004/0245043 | A1* | 12/2004 | Noselli et al. | 181/176 |
| 2004/0252856 | A1* | 12/2004 | Masuda | 381/340 |

FOREIGN PATENT DOCUMENTS

| | | | |
|---|---|---|---|
| WO | WO 03030583 | A2 * | 4/2003 |

* cited by examiner

SKEW HORN FOR A LOUDSPEAKER

TECHNICAL FIELD OF THE INVENTION

The invention relates generally to the field of waveguides, and, more particularly, to a skewed or off-angle horn for a loudspeaker system

BACKGROUND OF THE INVENTION

With the advent of better multi-channel audio technology for movie soundtracks encoded in formats such as DTS, DOLBY DIGITAL®, DVD Audio, DVD-A, Super Audio Compact Disc, SACD, and the like, surround-sound speakers capable of producing wide dispersion output have been in increasingly high demand for both auditorium and home theatre applications. Surround speaker requirements include diffuse dispersion in the horizontal plane to blur the time arrivals to the listener's ear. This concept is referred to as "reverb." The audio source may be music, a sound effect, or the like. Multiple speakers can be grouped together to provide a wide dispersion of sound, but there is a nontrivial likelihood that the interaction between such acoustic sources will be acoustically destructive, degrading the sound quality heard by a listener.

Ideally, a point source solution is the answer to this difficulty, but due to size limitations (i.e., most compression drivers are roughly cylindrical with outside diameters between about 5 and 8 inches, making close placement difficult) and limitations of power output capabilities, such a design is impractical and unfeasible in most working applications. Accuracy and intelligibility of acoustic signal is a result of the way the loudspeaker reconstructs the temporal and spectral response of the reproduced wave front. Phase coherence of the signal or wave front is a result of the temporal response when reconstructed. A number of difficulties arise when attempting to sum acoustic wavefronts from multiple drivers including standing waves interference and constructive/destructive amplitude interference caused by overlapping polar patterns between mutually driven acoustic sources.

In practice, the surround-sound speaker design has generally been approached by providing a di-, bi- or tri-polar speaker with 180 degrees dispersion in the horizontal axis. The difficulty with this design is that most transducers tend to narrow the dispersion angle as the wavelength of the output becomes smaller than the area of the transducer mouth and continues to narrow even more as the wavelength becomes smaller than the diameter of the voicecoil. This effect is referred to as "beaming". The waveguide geometry and/or the throat dimension of the compression driver and/or the diaphragm area of a dome tweeter, along with voicecoil diameter considerations, are the primary contributors to beaming. To avoid beaming, multiple transducers can be used in an arc or array to maximize the dispersion angle in the horizontal axis at the higher frequencies. Unfortunately, in some cases, the complication in this approach is that the polar patterns of dispersion tend to overlap or mesh at the lower frequencies, and thus do not sum acoustically as one wavefront in the axis wherein the transducers are placed due to polar patterns. The polar patter overlapping give rise to constructive/destructive interference, which is interpreted by the listener as a reduction in fidelity and sound quality. Therefore, beaming is reduced at the higher frequencies at the expense of sound quality from an incoherent wavefront reconstruction.

There are other horn designs wherein multiple transducers are arrayed and have polar patterns that match the desired effect of having a wide, consistent polar pattern, even at higher frequencies. The drawback is that the resultant configurations do not even approximate the desired flat front of the horn.

There are horns known in the art that have been developed to provide skewed areas of sound output. One such horn 1 is shown in FIG. 1, and uses a diffraction slot and throat geometry to increase the angle through which the sound output is directed. However, in many applications, such as home theater systems, it is desirable that the speakers be recess-mounted such that the speaker mouth is flush with the wall, and the mouth of the horn 1 of FIG. 1 is not flat. Skewed-angle dispersion loudspeaker horns have been developed to provide dispersed sound output through a flat or substantially flat mouth, and one such horn 2 is illustrated in FIGS. 2A-2B. The prior art horn of FIGS. 2A-2B utilizes a diffraction slot of variable width to skew the sound energy output off axis. However, the known prior art horns 1, 2 tend to have a maximum dispersion or skew angle of about 30 degrees. Further, these horns 1, 2 tend to not skew high frequency sound with wavelengths shorter than the throat dimension of the horn 1, 2. Additionally, the area expansion of the horn near the mouth has been abruptly truncated to provide a flat front. This can alter the amplitude response and polar pattern of the transducer.

Thus, there remains a need for a flat-mouth surround-sound speaker design that can provide surround-sound through a consistent and un-truncated area of expansion, through wider skew angles and over wider frequency ranges without experiencing both beaming and destructive interference. The present invention addresses this need.

SUMMARY OF THE INVENTION

The present invention relates to a horn having a substantially flat mouth opening connected to a transducer by an expanding area section or duct to a throat. A centerline oriented perpendicular to the transducer extends from the transducer along the throat to the mouth. The area of expansion or flare rate is substantially constant along the throat to the mouth. The angular dispersion of the horn is asymmetrical, and may be as great as 45 degrees. The horn does not require any baffling or diffraction slotting to achieve sonic dispersion.

One object of the present invention is to provide an improved loudspeaker horn design. Related objects and advantages of the present invention will be apparent from the following description.

DESCRIPTION OF THE PREFERRED EMBODIMENTS

Figure 1:
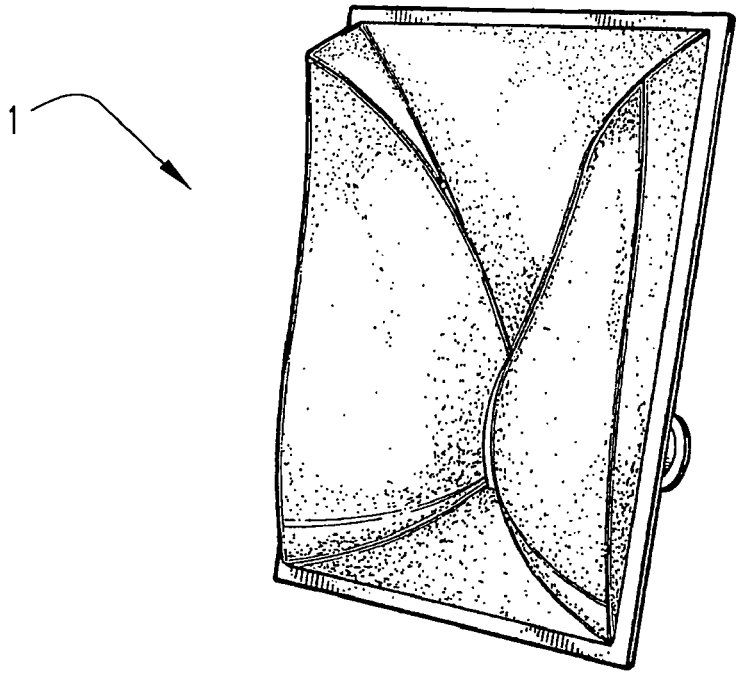
Fig. 1 (Prior Art)
FIG. 1 is a front perspective view of a first prior art horn.
Figure 2A:
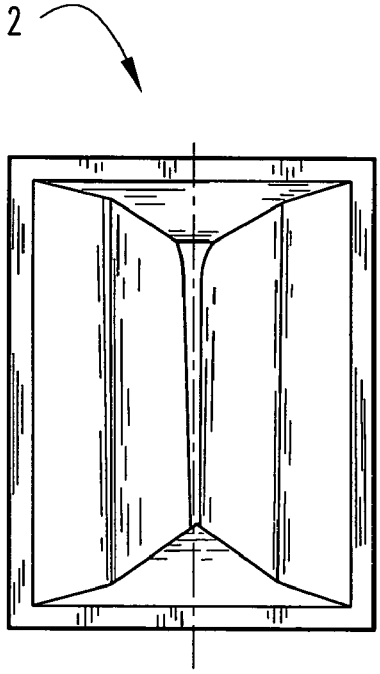
Fig. 2A (Prior Art)
FIG. 2AB is a front plan view a second prior art horn.
Figure 2B:
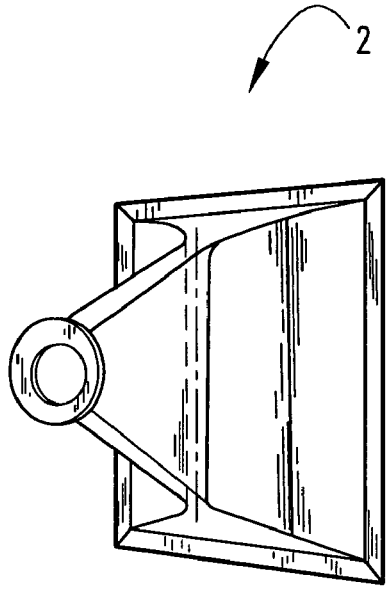
Fig. 2B (Prior Art)
FIG. 2B is a rear perspective view of the prior art horn of FIG. 2A.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Overview

A waveguide or horn loudspeaker may be thought of as an electro-acoustic transducer that translates an electrical signal into a directed acoustic signal. As use herein, "waveguide" means a conical or expanding duct or channel designed to confine and direct the propagation of modulated air pressure (i.e., acoustic waves) in a longitudinal direction. A waveguide typically consists of a coupling flange at its acoustical entrance for connecting a compression driver transducer thereto. The waveguide also typically terminates at a mouth and defines an expanding conduit or duct that exits to the ambient air. The waveguide also typically includes a mounting flange to affix the waveguide to a baffle board or other such enclosure, which may be an elaborate framework device or nothing more than a recess or cavity formed in a wall. An expanding duct extends between the acoustical entrance or throat (i.e, the transducer connection) and the mouth, and is typically characterized by an expanding cross-sectional area traveling from the transducer to the mouth. The path of the duct from the throat to the mouth is not always direct or linear, and may take one or more turns.

Generally, sound is generated by a transducer, such as a compression driver, operationally connected via the throat through the duct to the mouth of the horn. Horn speakers sound very dynamic and reproduce fast transients in their output due to their relatively low moving mass. For applications with total, symmetrical dispersion of less than about 90 degrees, a single horn using a single driver is usually adequate. For applications requiring wider dispersion angles and/or dispersion of higher frequencies, additional horns and drivers traditionally have been required. For applications requiring asymmetrical coverage patterns, skew horns are used.

Figure 3:
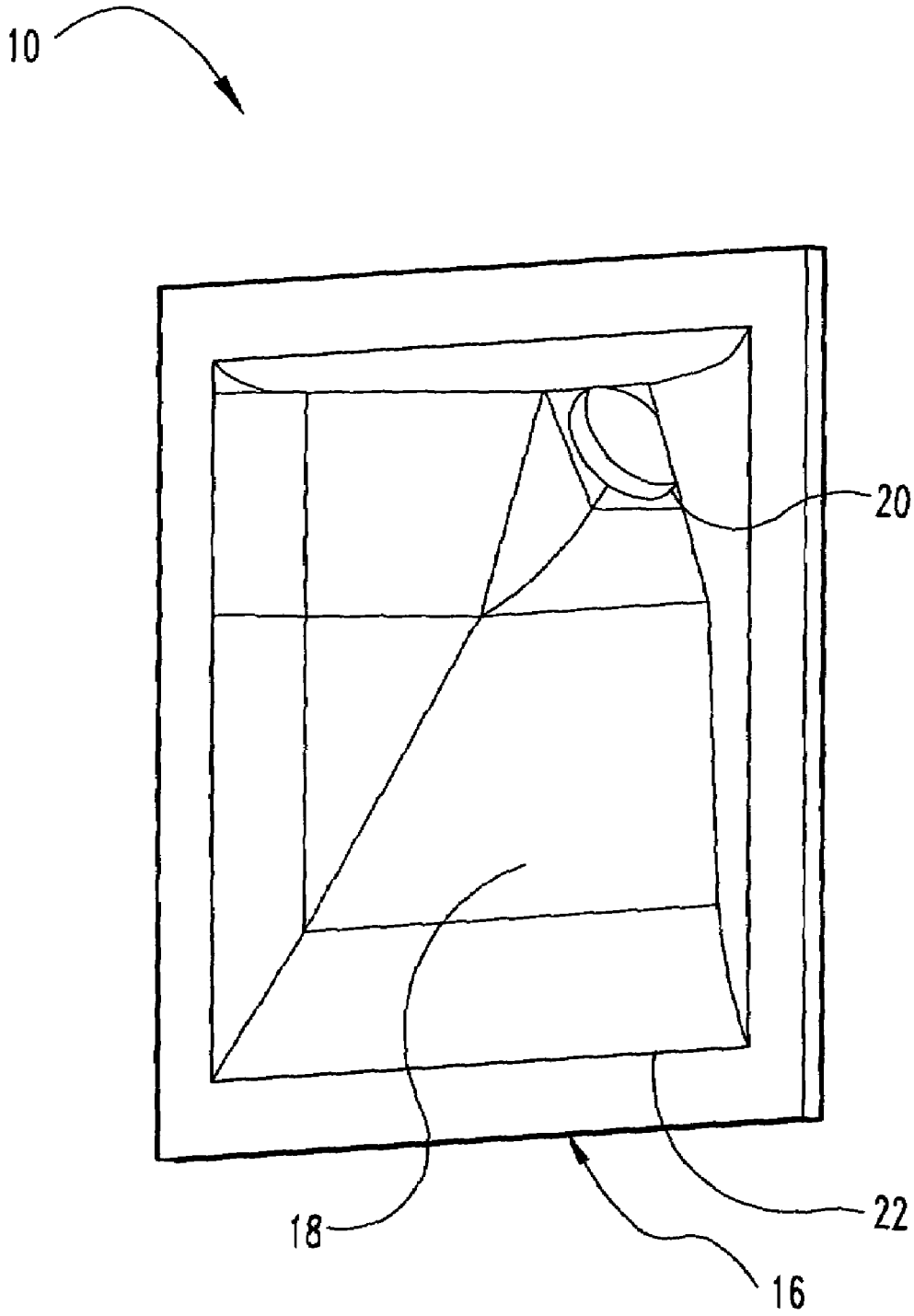
FIG. 3 is a front plan view of a first embodiment horn assembly of the present invention.
Figure 4:
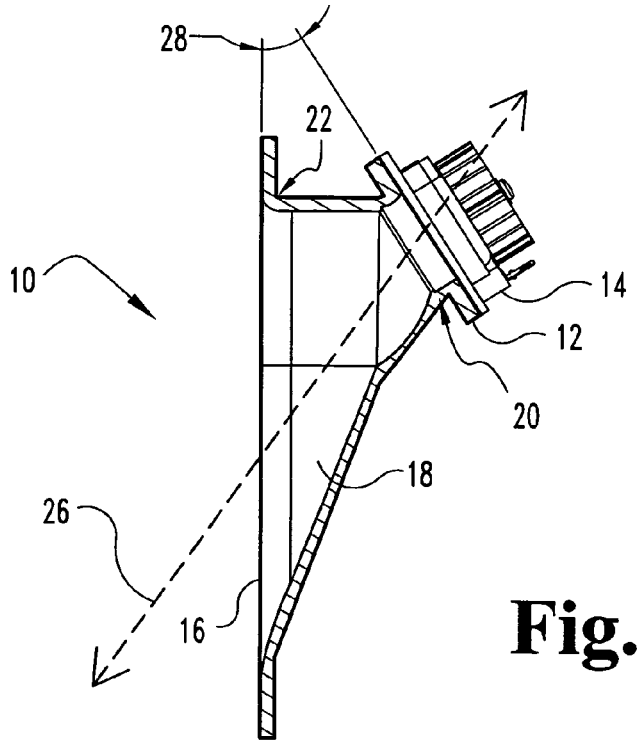
FIG. 4 is a top sectional view of the horn assembly of FIG. 3.
Figure 5:
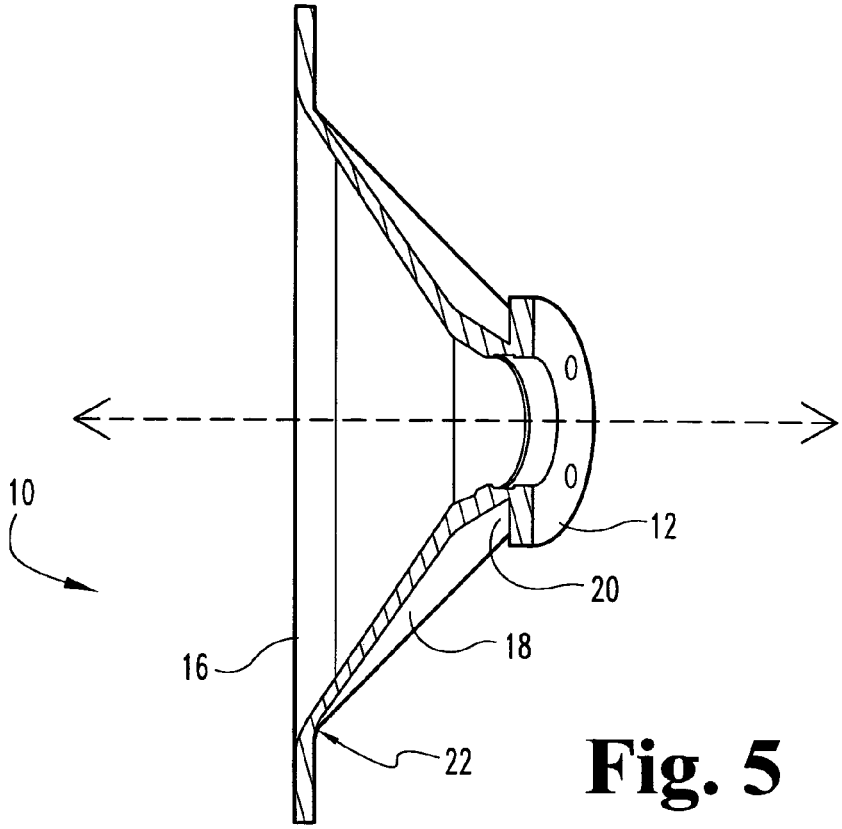
FIG. 5 is a side sectional view of FIG. 3.
Figure 7A:
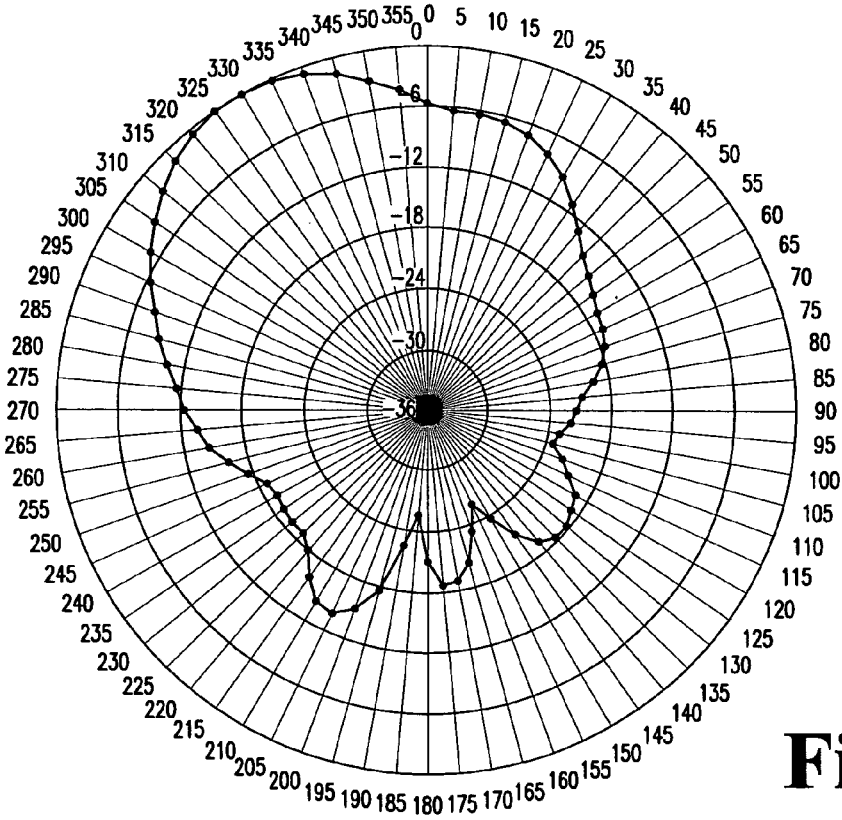
FIG. 7A is a graphic representation of experimentally measured horizontal polar response curves at a frequency of 3 kiloHertz for a first embodiment horn of the present invention.
Figure 10A:
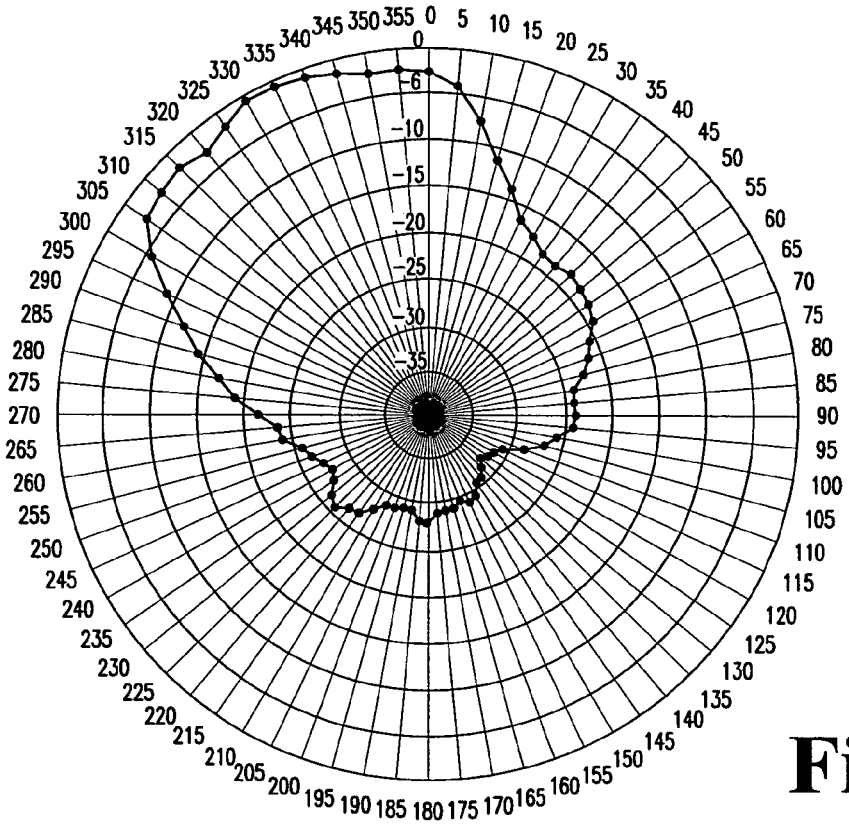
FIG. 10A is a graphic representation of experimentally measured horizontal polar response curves at a frequency of 16 kiloHertz for a first embodiment horn of the present invention.
Figure 7B:
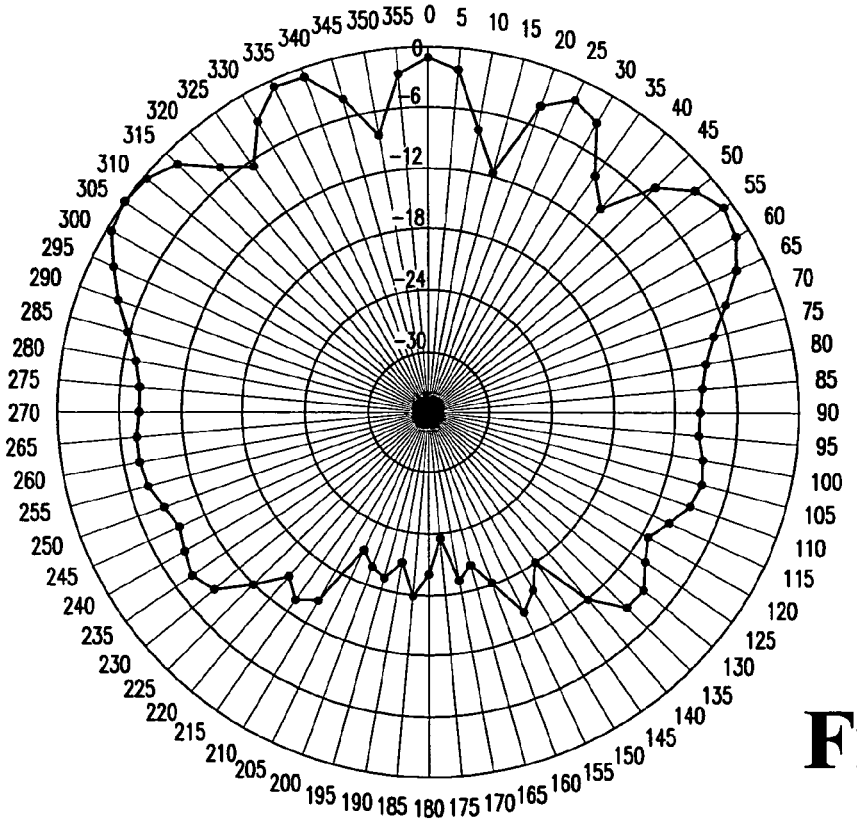
FIG. 7B is a graphic representation of experimentally measured horizontal polar response curves at a frequency of 3 kiloHertz for a known prior art horn.
Figure 10B:
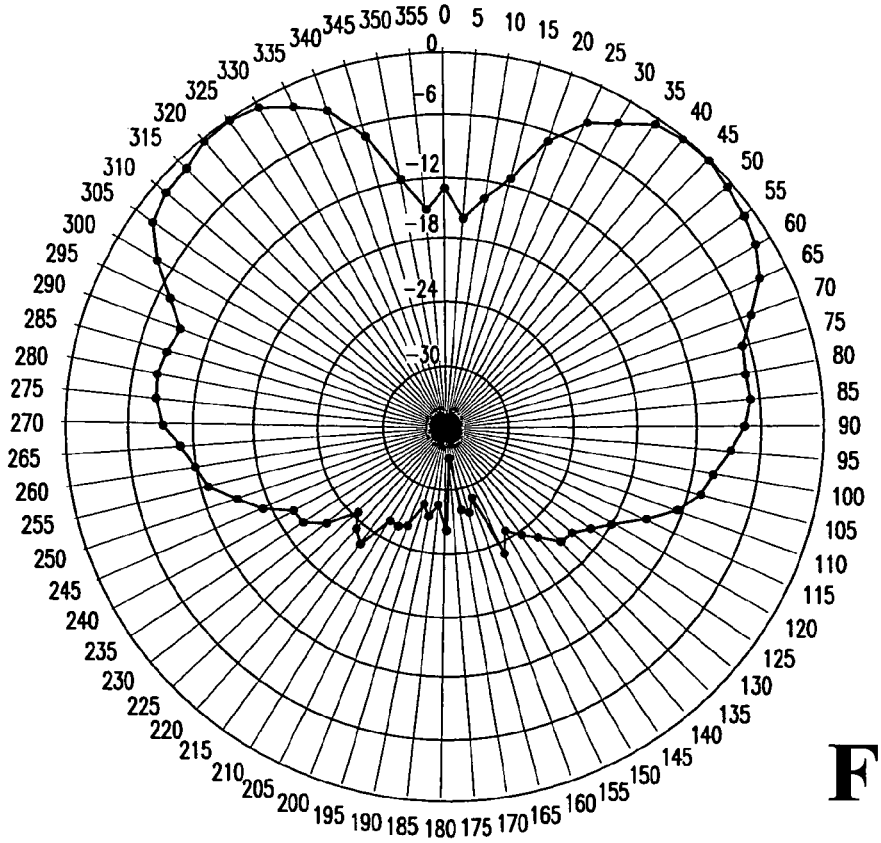
FIG. 10B is a graphic representation of experimentally measured horizontal polar response curves at a frequency of 16 kiloHertz for a known prior art horn.
Figure 7C:
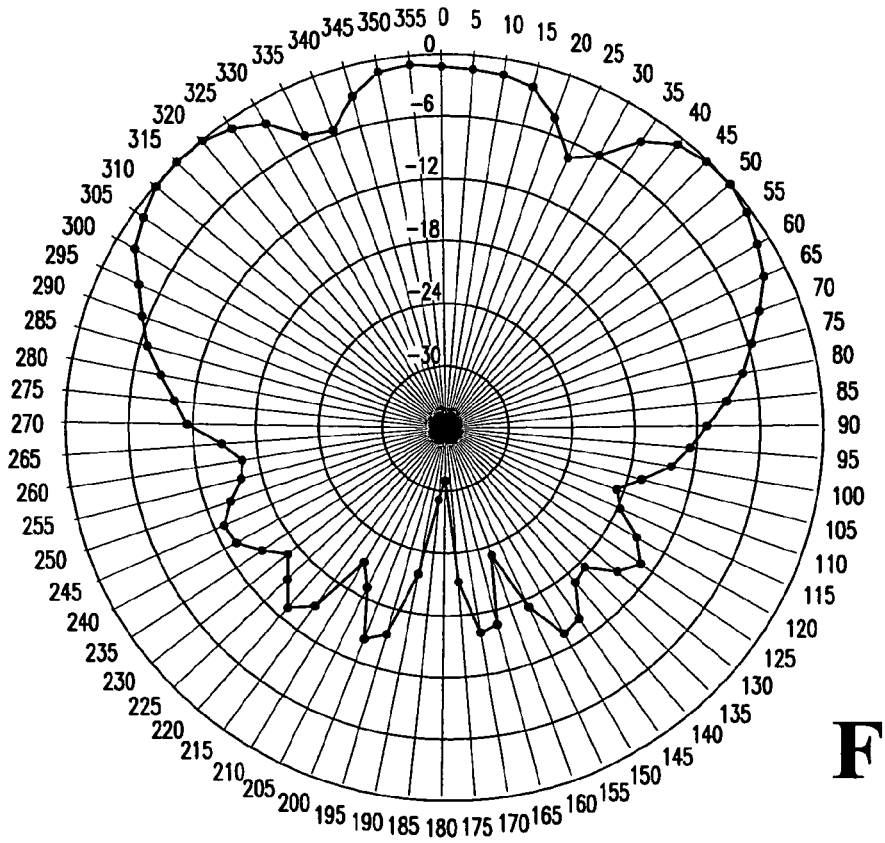
FIG. 7C is a graphic representation of experimentally measured horizontal polar response curves at a frequency of 3 kiloHertz for a pair of first side-by-side mounted embodiment horns of the present invention.
Figure 8A:
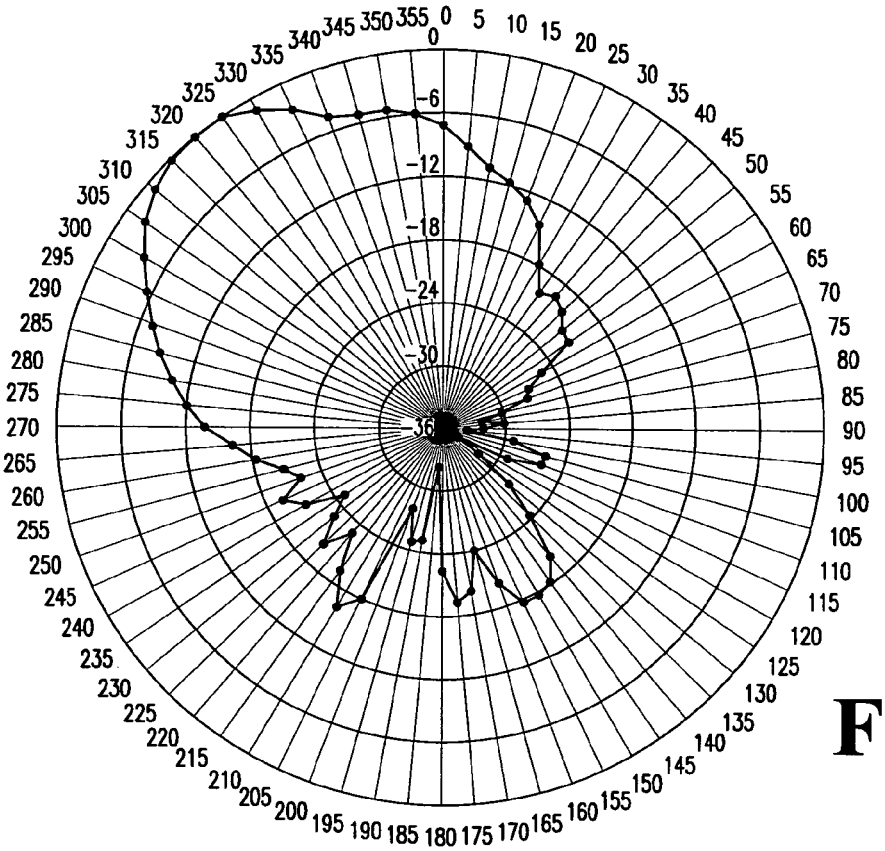
FIG. 8A is a graphic representation of experimentally measured horizontal polar response curves at a frequency of 5 kiloHertz for a first embodiment horn of the present invention.
Figure 9A:
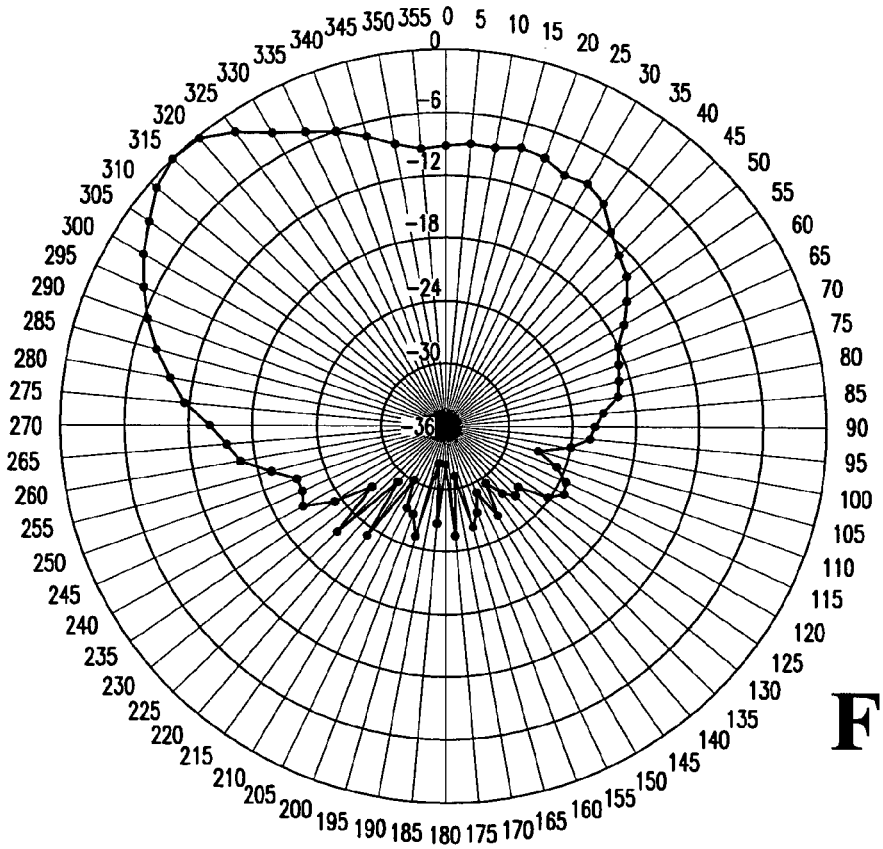
FIG. 9A is a graphic representation of experimentally measured horizontal polar response curves at a frequency of 9 kiloHertz for a first embodiment horn of the present invention.
Figure 8B:
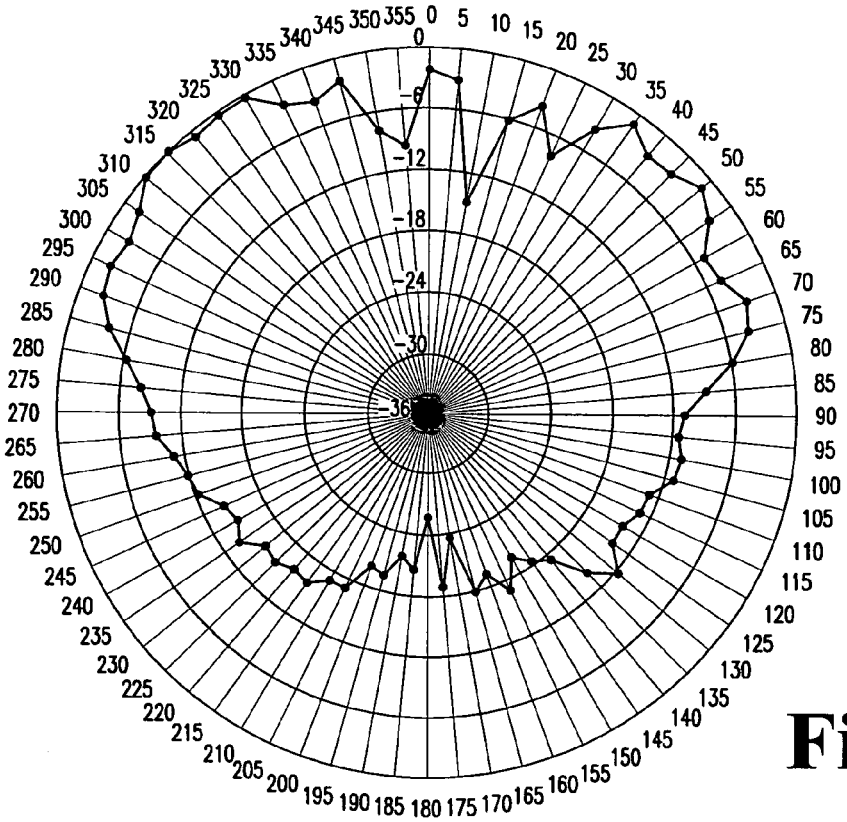
FIG. 8B is a graphic representation of experimentally measured horizontal polar response curves at a frequency of 5 kiloHertz for a known prior art horn.
Figure 9B:
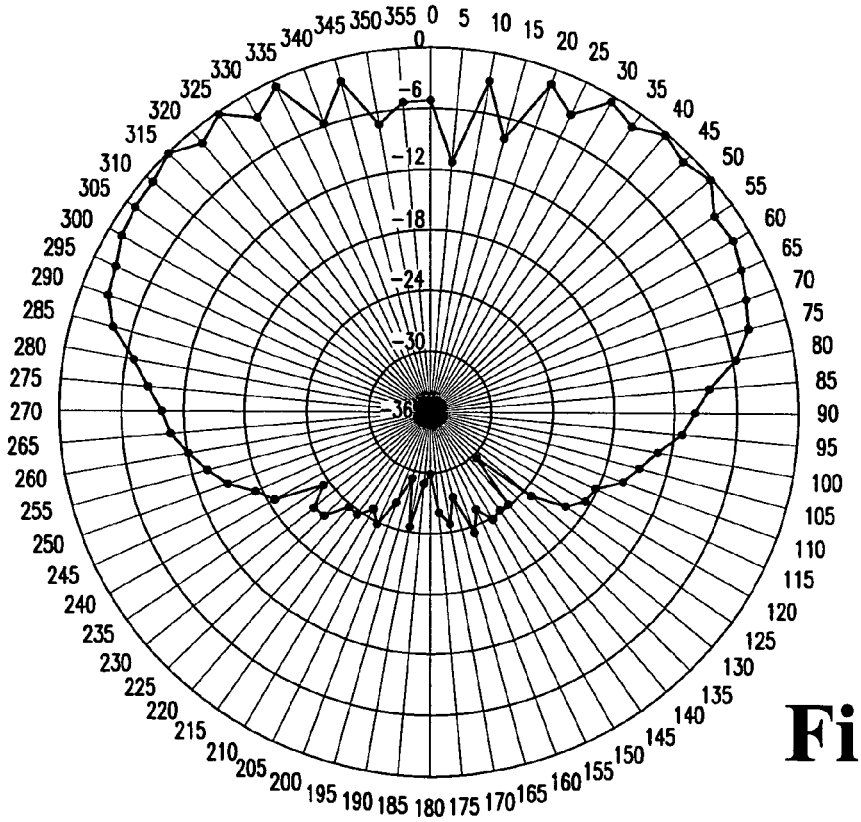
FIG. 9B is a graphic representation of experimentally measured horizontal polar response curves at a frequency of 9 kiloHertz for a known prior art horn.
Figure 8C:
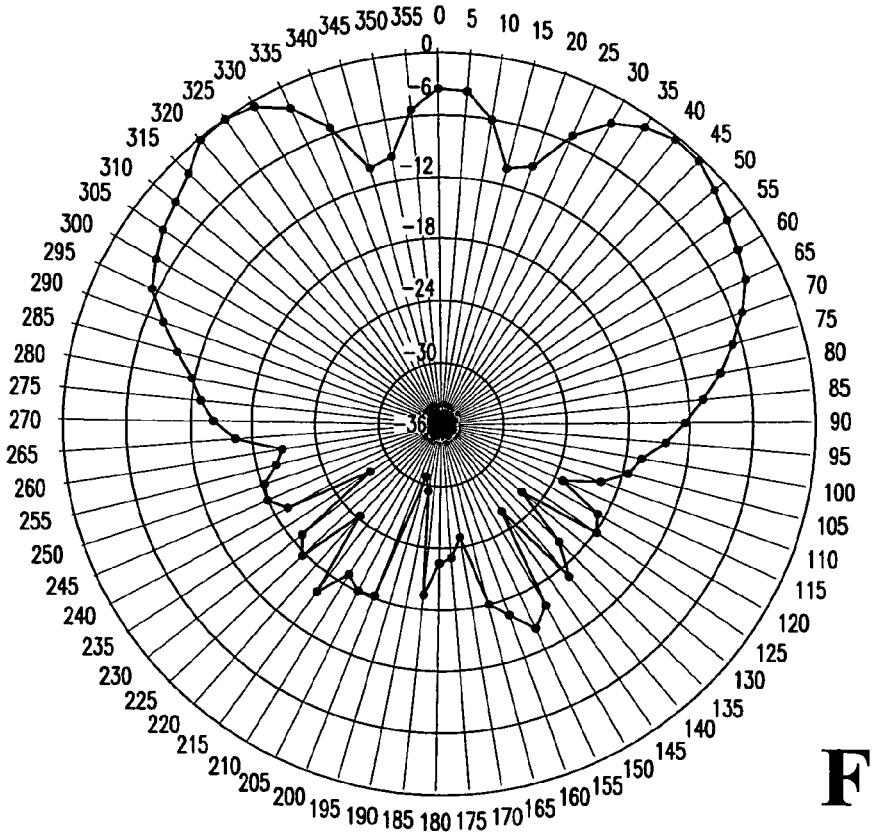
FIG. 8C is a graphic representation of experimentally measured horizontal polar response curves at a frequency of 5 kiloHertz for a pair of first side-by-side mounted embodiment horns of the present invention.
Figure 9C:
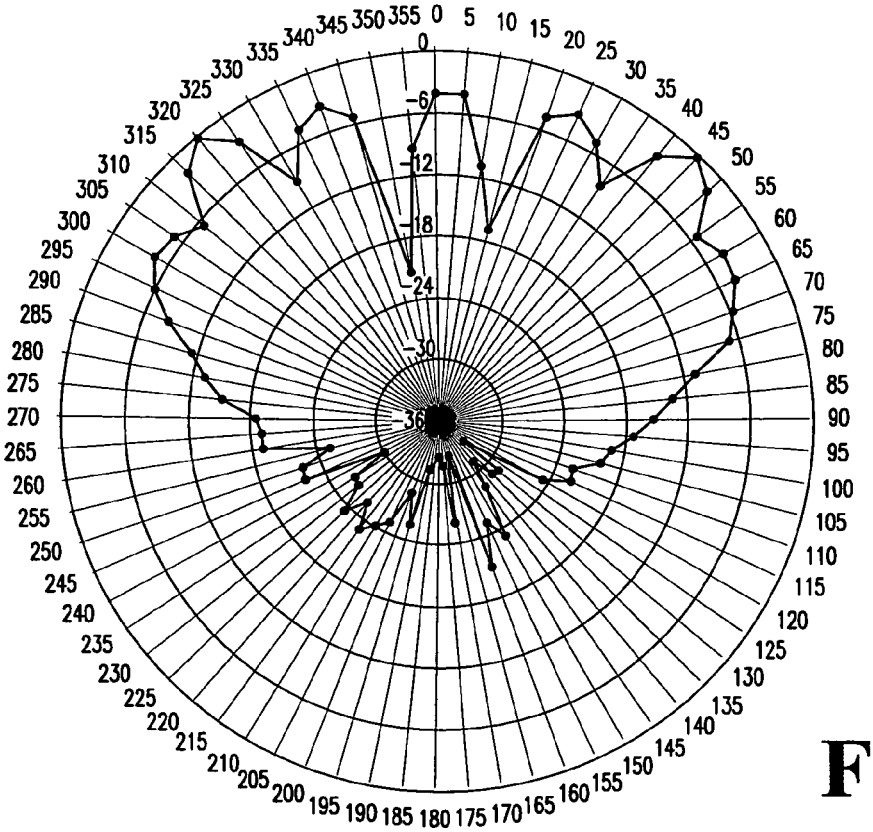
FIG. 9C is a graphic representation of experimentally measured horizontal polar response curves at a frequency of 9 kiloHertz for a pair of first side-by-side mounted embodiment horns of the present invention.
Figure 10C:
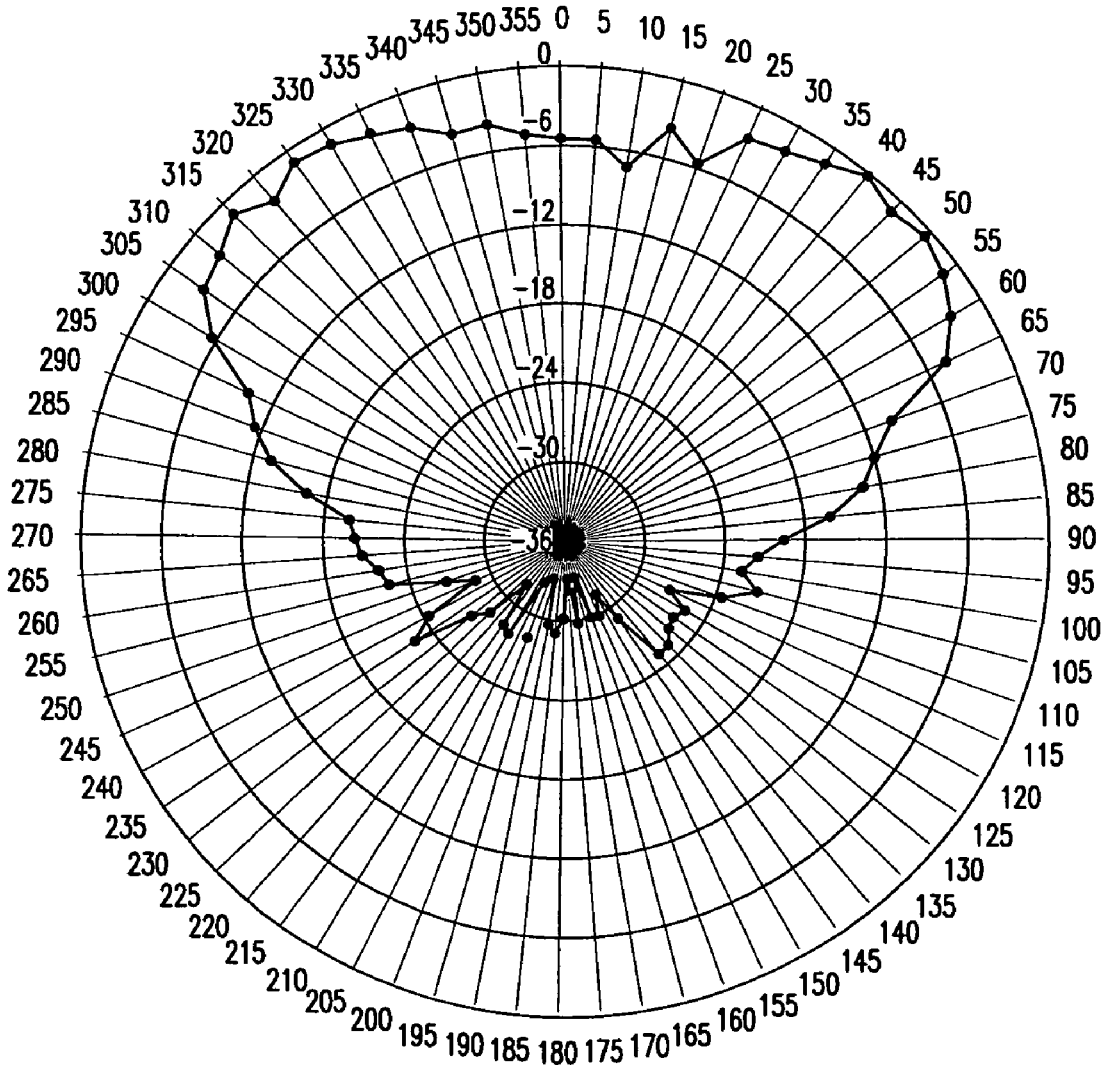
FIG. 10C is a graphic representation of experimentally measured horizontal polar response curves at a frequency of 16 kiloHertz for a pair of first side-by-side mounted embodiment horns of the present invention.

A first embodiment of the present invention is illustrated in FIGS. 3-5 and relates to a flat-front wide dispersion horn or waveguide 10 that may be used alone or as part of an array. Each individual horn 10 may be characterized by at least about 45 degrees and more typically 60 degrees or more of dispersion. Each horn 10 includes a transducer or acoustic source coupling flange 12 for connection to an acoustic source 14, a substantially flat or planar mouth 16 and a flared duct 18 extending therebetween. The coupling flange 12 enables mechanical and acoustic coupling of a transducer 14 thereto via a "bolt on", "screw on" or like mounting configuration. The application of signal to the transducer 14 results in the transduction of a (typically electrical) signal into modulated air pressure or sound waves. In the case of compression drivers 14, this occurs through oscillation of the voice coil in a magnetic gap. Once produced, the longitudinal sound waves travel down the duct 18, following the steadily increasing width or cross-sectional area of the duct 18. In other words, the sound waves propagate along the flared area of expansion, which widens approaching the mouth-connecting end 22 of the duct 18. The rate of increase of the area of expansion typically increases linearly from the throat end 20 to the mouth-connecting end 22.

The flared duct 18 is typically rectangular in cross-section, and more typically has the shape of a truncated cone at the throat end 20 characterized by an internal angle of between about 75 degrees and about 30 degrees. The flared duct 18 is further characterized by a major axis 26 extending therethrough. The major axis 26 intersects the coupling flange 12 and the mouth 16, and typically intersects the center or middle point of the coupling flange 12 perpendicularly and intersects the mouth 16.

The coupling flange 12 is typically flat and defines a coupling flange plane. Likewise, the transducer 14 typically has a flat face that abuts the coupling flange 12 at the coupling flange plane. The coupling flange plane 12A is typically not oriented parallel to the mouth plane 16A, but instead defines a horn angle 28 between the two planes 12A, 16A. The horn angle 28 is typically between about 0 degrees and about 60 degrees, and is more typically about 35 degrees. The horn angle 28 drives the skew or dispersion of the speaker 10.

In one particular embodiment, the mouth 16 is typically characterized by an area of between about 180 square centimeters and about 300 square centimeters, and is more typically characterized by an area of about 230 square centimeters. Likewise, in this particular embodiment, the mouth 16 is rectangular in shape; in other embodiments, the mouth 16 may be oval, circular, or any desired shape.

Figure 6:
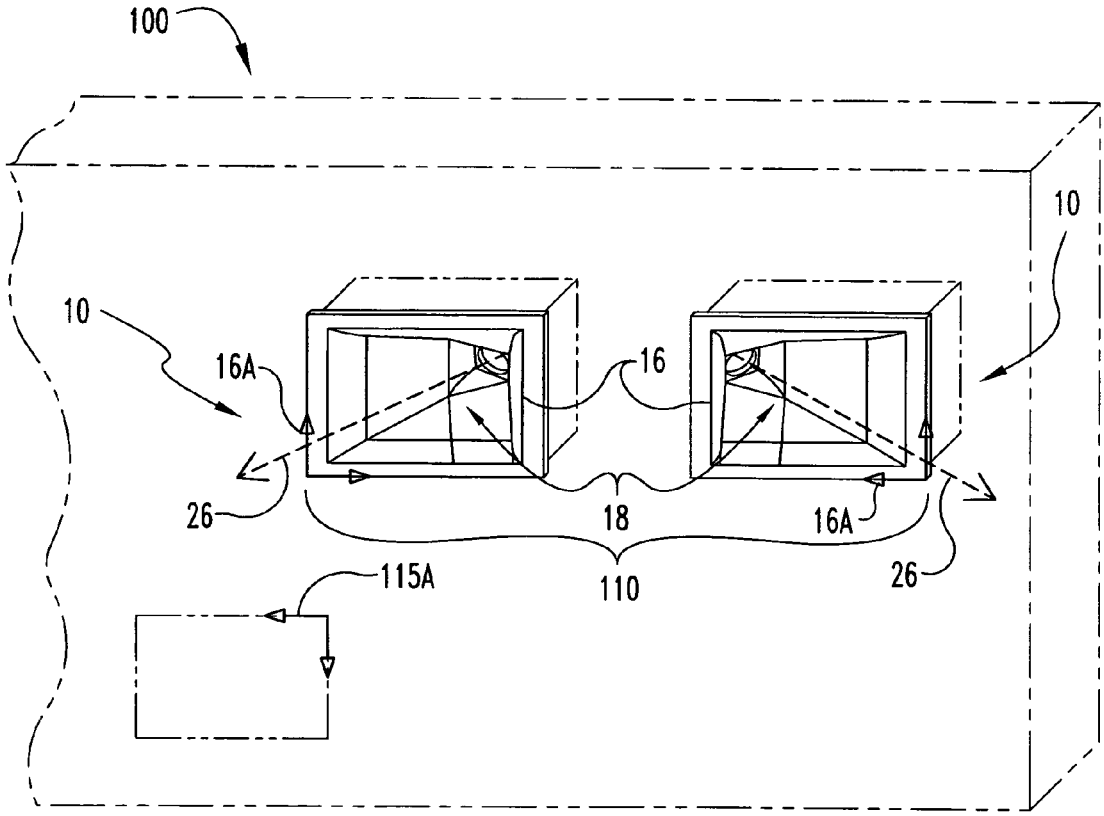
FIG. 6 is a front elevation view of a second embodiment of the present invention, a pair of first embodiment horns installed in wall recesses.

FIG. 6 illustrates a second embodiment of the present invention, a speaker system 100 including a horn assembly 110 having a plurality of horns 10 recessed in a wall. The mouth planes 16A of the horns 10 are coplanar or substantially coplanar with the wall plane 115 defined by the flat surface of the wall. Each horn 10 in the assembly 110 typically defines a mouth 16, an elongated duct 18 and a driver or transducer 14 as described above regarding FIGS. 3-5. The duct 18 is essentially a hollow truncated cone or tube positioned between and acoustically connecting the substantially planar mouth 16 and the driver 14 via the substantially flat coupling flange 12. As above, the driver 14 may typically be thought of as defining a substantially flat output plane 12A coplanar and indistinguishable from the coupling flange plane 12A and nonparallel with the mouth plane 16A. The duct 18 is further characterized by a central or major axis 26 extending therethrough, which is typically normal to the output plane 12A and may or may not be normal to the mouth plane 16A. It is convenient to note that the central axis 26 also defines the primary direction of acoustic output of the horn 10, and that the central axes 26 of the horns 10 defining the array 110 are typically not oriented in parallel with each other. In other words, the horn array 110 includes at least two horns 10 having throats 18 defining nonparallel axes 26 and thus producing a wider combined output (i.e., over a larger angle) than a single prior art horn alone is capable of producing.

Typically, the array 110 includes two horns 10 defining two nonparallel axes 26; more typically, the axes 26 are oriented at an angle of at least about 60 degrees relative each other; still more typically, the axes 26 are oriented at an angle of about 90 degrees relative each other. When three horns 10 are arrayed, the outer horns 10 are typically oriented symmetrically about the middle horn, and more typically, each outer horn 10 is oriented at an angle of between about 45 degrees and about 60 degrees with the middle horn 10.

In operation, the drivers 14 is connected to a signal source, such as an audio amplifier, a tuner, an A/V receiver, or the like, and is energized by a signal from the same. The driver 14 transduces the signal into an acoustic signal (i.e., modulated pressure waves) that propagates along the connected duct 18 and exits the mouth 16 of the horn 10.

FIGS. 7A-10C illustrate the polar directivity of the acoustic output of the horn 10 of the present invention (A series) as compared to a standard prior art horn (B series) and as combined with another horn of the present invention (C series). The data comprising FIGS. 7A-10C was generated experimentally via the well-known acoustic techniques of rotating the horn 10 on a standard baffle in a spherical pattern every 5 degrees to closely approximate an in-wall speaker system.

As shown in FIGS. 7A, 8A, 9A and 10A, 10 is the polar directivity of the acoustic output of the speaker system substantially smooth and generally constant over a wide dispersion angle and over a broad range of frequencies in a first (typically horizontal) plane. As can be seen, at a frequency of 3000 Hz, the acoustic dispersion of the speaker system 10 is substantially constant over a 70-degree angle, with the −6 dB down points occurring at about +/−35 degrees from center in the horizontal plane. (See FIG. 7A). At 5,000 Hz in the horizontal plane, the speaker system 10 exhibits a substantially constant acoustic dispersion over about 60 degrees, with −6 dB down points at about +/−30 degrees from center (see FIG. 8A.) At 9,000 Hz in the horizontal plane, the speaker system 10 exhibits a substantially constant acoustic dispersion over about 50 degrees, with −6 dB down points at about +/−25 degrees from center; at 9,000 Hz, the acoustic output does exhibit some lobing formation due to the interference effects of phase summation. (See FIG. 9A). At 16,000 Hz in the horizontal plane, the speaker system 10 exhibits a substantially constant acoustic dispersion over about 65 degrees, with −6 dB down points at about +/−33 degrees from center. (See FIG. 10A).

FIGS. 7B, 8B, 9B and 10B represent the polar directivity of the acoustic output of a prior art speaker system at the same frequencies (3 kHz, 5 kHz, 9 kHz and 16 kHz, respectively.) FIGS. 7C, 8C, 9C and 10C illustrate the polar directivity of the acoustic output of a second embodiment speaker system 100 including a pair of speakers 10 aimed away from one another at the same frequencies (3 kHz, 5 kHz, 9 kHz and 16 kHz, respectively.) The objective of the speaker system 100 was to generate results at least matching, if not exceeding, those of the prior art speakers while enjoying the advantage of flat or flush mounting the speakers 10 of the system 100 into a flat baffle, such as a wall.

At 3000 Hertz, the polar output of prior art speaker is characterized by four deep notches and a dispersion pattern of about 145 degrees. In contrast, the speaker system 100 of the present invention is characterized by only two relatively shallow notches and a dispersion pattern of about 150 degrees. (See FIGS. 7B and 7C). At 5000 Hertz, the polar output of prior art speaker is characterized by three notches and a dispersion pattern of about 160 degrees, while the instant speaker system 100 is characterized by two relatively shallow notches and a dispersion pattern of about 140 degrees. (See FIGS. 8B and 8C). At a frequency of 9000 Hertz, the polar output of prior art speaker is characterized by two deep notches and a dispersion pattern of about 160 degrees. In contrast, the speaker system 100 of the present invention is characterized by two notches and a dispersion pattern of about 135 degrees. (See FIGS. 9B and 9C). At 16,000 Hertz, the polar output of prior art speaker is characterized by a single pronounced and deep notch and a dispersion pattern of about 135 degrees, while the instant speaker system 100 is characterized one much more shallow and less pronounced notch and a dispersion pattern of about 125 degrees. (See FIGS. 10B and 10C). It is evident that the speaker system 100 of the present invention has matched and/or exceeded the performance of the prior art speakers at each frequency measured while enjoying the advantage of having a flat front mounting face.

Figure 11A:
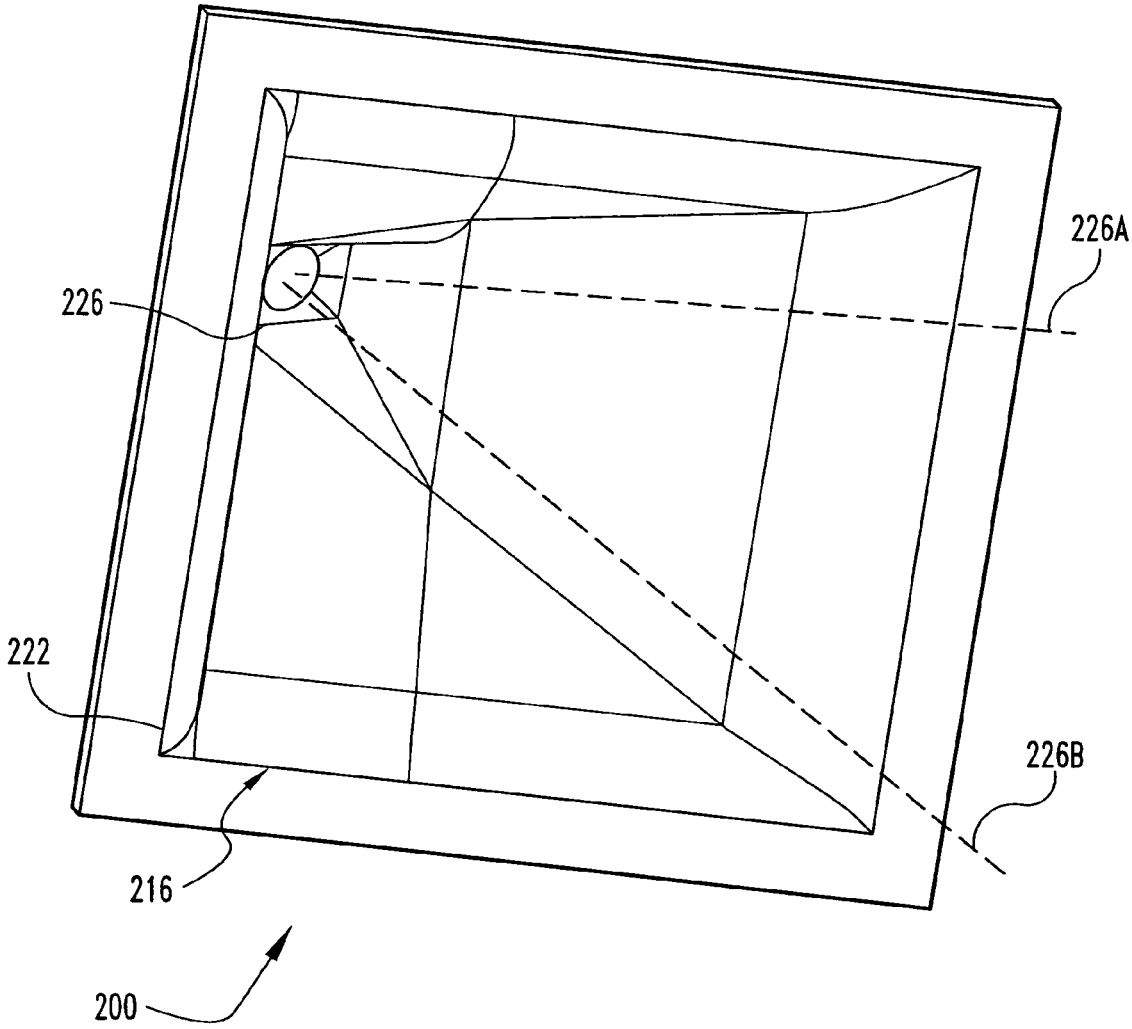
FIG. 11A is a front plan view of a third embodiment horn assembly of the present invention.
Figure 11B:
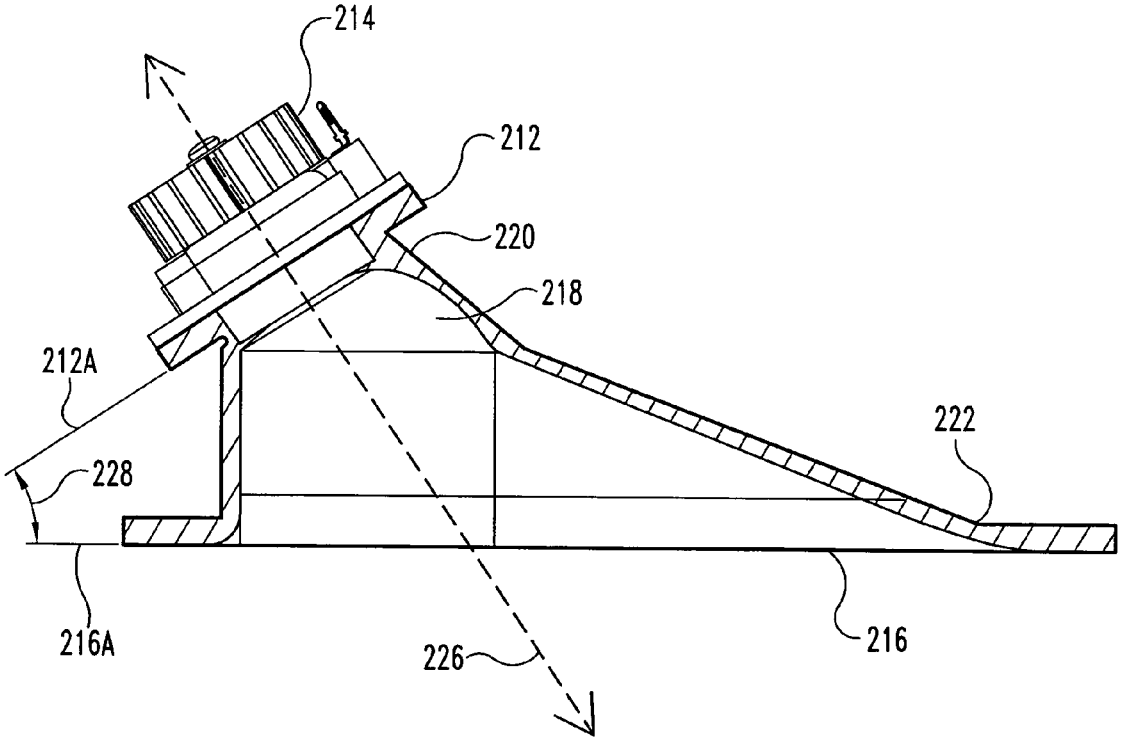
FIG. 11B is a side sectional view of the horn assembly of FIG. 11A.
Figure 11C:
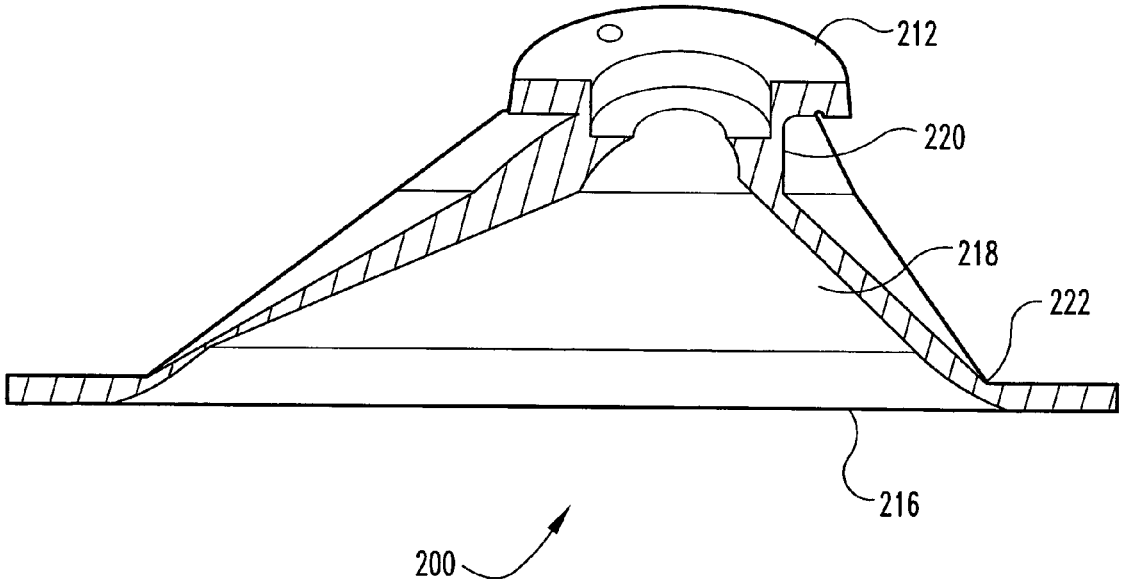
FIG. 11C is a top sectional view of FIG. 11A.

FIGS. 11A-11C illustrate a third embodiment of the present invention, a horn 200 that may be characterized by at least about 30 degrees (and more typically at least about 45 degrees) of dispersion in a first plane and at least about 30 degrees (and more typically at least about 45 degrees) of dispersion in a second plane. As in the first embodiment horn 10, the horn 200 includes a transducer or acoustic source coupling flange 212 for connection to an acoustic source 214, a substantially flat or planar mouth 216 and a flared duct 218 extending therebetween. Application of signal to the transducer 214 results in the transduction of a signal into modulated air pressure or sound waves that travel down the duct 218, following the steadily increasing width or cross-sectional area of the duct 218. The duct 218 widens approaching the mouth-connecting end 222 of the duct 218, with the rate of increase of the area of expansion typically increasing linearly from the throat end 220 to the mouth-connecting end 222.

The flared duct 218 is again typically rectangular in cross-section, and more typically has the shape of a truncated cone at the throat end 220 characterized by an internal angle of between about 75 degrees and about 30 degrees. As seen in FIGS. 11A and 11C, the flared duct 218 and coupling flange 212 are offset such that the horn 200 is characterized by a skewed acoustic output in at least two planes, which may or may not be orthogonal to one another. The flared duct 218 is further characterized by a major axis 226 extending therethrough, and further characterized by minor axes 226A, 226B, each within one of the planes of skewed output. The major axis 226 intersects the coupling flange 212 and the mouth 216, and typically intersects the center or middle point of the coupling flange 212 perpendicularly and intersects the mouth 216.

The coupling flange 212 is typically flat and defines a coupling flange plane. Likewise, the transducer 214 typically has a flat face that abuts the coupling flange 212 at the coupling flange plane. The coupling flange plane 212A is typically not oriented parallel to the mouth plane 216A, but instead defines a horn angle 228 between the two planes 212A, 216A. The horn angle 228 is typically between about 0 degrees and about 60 degrees, and is more typically about 35 degrees.

In operation, the horn 200 skews acoustic output energy or polar patterns in two planes. For example, the horn 200 may be placed in a corner of a room (typically flush-mounted in the ceiling) and the acoustic output is directed towards the center of the room instead of bouncing off of the walls. Further, by arraying horns 200 together, coverage in one or more desired output planes may be substantially broadened.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A horn, comprising:

a substantially flat coupling flange defining a coupling flange plane;

a substantially planar mouth defining a mouth plane;

an elongated duct having a transducer-connecting end and a mouth-connecting end and extending between the coupling flange and the mouth;

a transducer for generating a sonic output operationally connected to the coupling flange; and a major axis substantially perpendicular to the coupling flange plane extending through the elongated duct;

wherein the coupling flange plane and the mouth plane are nonparallel and define a horn angle;

wherein the major axis is substantially parallel to a skew angle of the horn;

wherein the major axis connects the coupling flange and the mouth; and wherein the elongated duct is characterized by a substantially steadily increasing sectional area along the major axis from the transducer-connecting end to the mouth connecting end such that sound waves generated by said transducer propagate unreflected down the elongated duct.

2. The device of claim 1 further comprising:

a wall defining a wall plane; and a recess formed in the wall and sized to receive the horn;

wherein the horn is received within the recess; and wherein the mouth plane and the wall plane are substantially coplanar.

3. The device of claim 1 wherein the horn is characterized by a skew angle of at least about 45 degrees.

4. The device of claim 1 wherein the horn is characterized by a skew angle of at least about 60 degrees.

5. The device of claim 1 wherein the mouth is a rectangle with an area of the about 230 square centimeters.

6. The device of claim 1 wherein the horn is characterized by acoustic output skewed in two planes.

7. The device of claim 6 wherein the acoustic output is skewed at least about 30 degrees in each respective plane.

8. The device of claim 6 wherein the acoustic output is skewed at least about 45 degrees in each respective plane.

9. The device of claim 1 wherein the throat is characterized by a substantially truncated cone shape and wherein the flare angle of the cone is between about 30 degrees and about 75 degrees.

10. The device of claim 1 wherein the horn angle is about 35 degrees.

11. The device of claim 1 wherein the coupling flange has a flange center and wherein mouth has a mouth center and wherein the major axis intersects the flange center and the mouth center.

12. A loudspeaker horn for mounting in a recess formed in a substantially planar wall, comprising in combination:

a flared throat defining a throat axis;

a mouth defining a mouth plane;

a first substantially flat acoustic transducer surface defining a transducer surface plane and acoustically connected to the throat;

wherein the mouth plane is substantially coplanar with the wall plane;

wherein the mouth plane and the transducer surface plane are nonparallel and define a horn angle;

wherein the throat axis intersects the first transducer surface substantially in the middle;

wherein the throat axis intersects the mouth substantially in the middle; and wherein the throat is defined by a steadily increasing flare from the transducer surface to the mouth such that sound waves generated by said transducer propagate unreflected down the elongated throat.

13. The device of claim 12 wherein the loudspeaker horn has a characteristic output frequency range and wherein the loudspeaker horn is characterized substantially over its output frequency range by a skew angle of at least about 45 degrees.

14. The device of claim 12 wherein the loudspeaker horn has a characteristic output frequency range and wherein the loudspeaker horn is characterized substantially over its output frequency range by a skew angle of at least about 60 degrees.

15. The device of claim 12 wherein the flared duct is substantially defined by a flare angle of between about 30 degrees and about 75 degrees.

16. The device of claim 12 wherein the horn is characterized by acoustic output skewed in two planes.

17. The device of claim 12 wherein the horn angle is about 35 degrees.

18. A speaker system, comprising:

a first waveguide further comprising:

a first acoustic driver;

a first substantially flat coupling flange operationally connected to the first acoustic driver;

a first mouth defining a first mouth plane;

a first flared throat operationally connected between the first substantially flat coupling flange and the first mouth; and a first throat axis extending along the first flared throat between the first substantially flat coupling flange and the first mouth;

wherein the first substantially flat coupling flange and the first mouth plane are nonparallel and define a first horn angle therebetween;

a second waveguide further comprising:

a second acoustic driver;

a second substantially flat coupling flange operationally connected to the second acoustic driver;

a second mouth defining a second mouth plane;

a second flared throat operationally connected between the second substantially flat coupling flange and the second mouth; and a second throat axis extending along the second flared throat between the second substantially flat coupling flange and the second mouth;

wherein the second substantially flat coupling flange and the second mouth plane are nonparallel and define a second horn angle therebetween;

wherein each respective throat is characterized by a substantially steadily increasing sectional area from the respective substantially flat coupling flange to the respective mouth;

wherein sound waves generated by said first acoustic driver and said second acoustic driver travel substantially unreflected down each respective throat;

wherein the speaker system is characterized by an acoustic dispersion angle of about thirty degrees in a first dispersion plane;

wherein the speaker system is characterized by an acoustic dispersion angle of at least ninety degrees in a second dispersion plane oriented orthogonally to the first dispersion plane; and wherein the first and second mouth planes are substantially coplanar.

19. The system of claim 18 wherein the first dispersion plane is substantially horizontal and wherein the second dispersion plane is substantially vertical.

20. The system of claim 18 wherein the first dispersion plane is substantially vertical and wherein the second dispersion plane is substantially horizontal.

* * * * *